US011373556B1

(12) United States Patent
Quick et al.

(10) Patent No.: US 11,373,556 B1
(45) Date of Patent: Jun. 28, 2022

(54) SHIPPING LABEL WITH PERIMETER ADHESIVE

(71) Applicant: WARD KRAFT, INC., Fort Scott, KS (US)

(72) Inventors: Phil Quick, Fort Scott, KS (US); Roger Kraft, Fort Scott, KS (US); Jesse Crum, Fort Scott, KS (US)

(73) Assignee: Ward-Kraft, Inc., Fort Scott, KS (US)

( * ) Notice: Subject to any disclaimer, the term of this patent is extended or adjusted under 35 U.S.C. 154(b) by 0 days.

(21) Appl. No.: 15/667,102

(22) Filed: Aug. 2, 2017

Related U.S. Application Data

(60) Provisional application No. 62/369,835, filed on Aug. 2, 2016.

(51) Int. Cl.
*G09F 3/10* (2006.01)
*G09F 3/02* (2006.01)

(52) U.S. Cl.
CPC ..... *G09F 3/10* (2013.01); *G09F 3/02* (2013.01); *G09F 2003/0222* (2013.01); *G09F 2003/0245* (2013.01); *G09F 2003/0269* (2013.01)

(58) Field of Classification Search
CPC ..... G09F 3/10; G09F 3/02; G09F 2003/0222; G09F 2003/0245; G09F 2003/0225; G09F 2003/0227; B42D 15/006
See application file for complete search history.

(56) References Cited

U.S. PATENT DOCUMENTS 5,704,648 A * 1/1998 Brown ..... C09J 7/38 283/81
5,846,624 A * 12/1998 Denklau ..... G09F 3/10 283/81
6,039,356 A * 3/2000 Warther ..... B42D 5/027 283/61
6,616,189 B2 * 9/2003 Raming ..... B42D 15/006 283/81
RE39,100 E * 5/2006 Raming ..... B42D 15/006 156/1
8,109,537 B2 * 2/2012 Raming ..... B65C 1/02 283/81
8,261,477 B1 * 9/2012 Wilkinson ..... G09F 3/204 283/81
8,322,061 B1 * 12/2012 Kraft ..... G09F 3/0289 283/81
8,857,943 B2 * 10/2014 Raming ..... B41J 3/4075 347/101
9,870,724 B1 * 1/2018 Van Gorp ..... G09F 3/0288
(Continued)

*Primary Examiner* — David R Dunn
*Assistant Examiner* — Christopher E Veraa
(74) *Attorney, Agent, or Firm* — Avek IP, LLC

(57) ABSTRACT

A shipping label is formed of a single ply and is configured to be removably adhered to a liner. The shipping label has a front face configured for the printing of indicia. The label has a back face having a first strip of adhesive, a second strip of adhesive, and a printable area. The first and second adhesive strips respectively extend along a top edge and a bottom edge of the shipping label. The printable area is between the first and second adhesive strips. The liner associated with the shipping label is configured to be removably secured to the first and second adhesive strips. The printable area is adapted to be printed while the liner is removably secured to the first and second adhesive strips.

13 Claims, 9 Drawing Sheets

(56) References Cited

U.S. PATENT DOCUMENTS

| | | | | |
|---|---|---|---|---|
| 2003/0051383 | A1* | 3/2003 | Attia | B42F 21/065 40/641 |
| 2006/0091671 | A1* | 5/2006 | Raming | B42D 15/006 283/105 |
| 2006/0233994 | A1* | 10/2006 | Hodsdon | B32B 3/02 428/40.1 |
| 2009/0092781 | A1* | 4/2009 | Guzi | B32B 7/06 428/42.3 |
| 2010/0259037 | A1* | 10/2010 | Hanrahan | B65C 9/1884 283/81 |
| 2010/0293829 | A1* | 11/2010 | Miles | G09F 3/0288 40/638 |
| 2011/0233095 | A1* | 9/2011 | Seidl | G09F 3/0288 206/459.5 |
| 2011/0309608 | A1* | 12/2011 | Flynn | G09F 3/10 283/81 |
| 2012/0100328 | A1* | 4/2012 | Uribe | G09F 3/0289 428/43 |
| 2012/0234481 | A1* | 9/2012 | Raming | G09F 3/0288 156/249 |
| 2013/0249205 | A1* | 9/2013 | Bellmyer | G09F 3/02 283/81 |
| 2014/0117659 | A1* | 5/2014 | Raming | G09F 3/10 283/81 |
| 2014/0295121 | A1* | 10/2014 | Ogden | G09F 3/10 428/41.9 |
| 2016/0180749 | A1* | 6/2016 | Sato | G09F 3/10 428/42.2 |
| 2016/0293063 | A1* | 10/2016 | Weiner | B32B 3/02 |

* cited by examiner

SHIPPING LABEL WITH PERIMETER ADHESIVE

CROSS REFERENCE TO RELATED APPLICATIONS

This application claims priority to U.S. Provisional Patent Application Ser. No. 62/369,835, titled "Shipping Label with Perimeter Adhesive" filed Aug. 2, 2016, the disclosure of which is incorporated herein by reference in its entirety.

FIELD OF THE INVENTION

The disclosure relates generally to the field of shipping labels. More specifically, the disclosure relates to a shipping label having printable areas on both sides thereof.

BACKGROUND

Labels, such as shipping labels, are ubiquitous. Shipping labels are generally configured to resist peeling off the package to which they are adhered, and to resist fading from exposure to heat and light. The labels are also, in general, configured to receive machine readable or other indicia, and in large scale applications, are adapted for use with automated systems.

On average, about twenty-five million packages are processed by just two of the major package couriers in the United States alone each day. Each of these packages has at least one label situated thereon, which outlines, for example, the name and address of the recipient of the package. The exorbitant number of labels has associated therewith a significant cost. It may be desirable to reduce the costs associated with the labels, without adversely affecting the functionality thereof. It may also be desirable to produce labels that are environmentally friendlier relative to the traditional shipping labels. The present disclosure is directed generally to shipping labels that may satisfy these and other objectives.

SUMMARY

A shipping label, according to an embodiment, is formed of a single ply and is configured to be removably adhered to a liner. The shipping label has a front face configured for the printing of indicia. The label has a back face having a first strip of adhesive, a second strip of adhesive, and a printable area. The first and second adhesive strips respectively extend along a top edge and a bottom edge of the shipping label. The printable area is between the first and second adhesive strips. The liner associated with the shipping label is configured to be removably secured to the first and second adhesive strips. The printable area is adapted to be printed while the liner is removably secured to the first and second adhesive strips.

According to another embodiment, a method for reducing waste associated with shipping labels comprises the step of providing a single-ply shipping label to which a liner is to be adhered. The shipping label has a front face configured for the printing of indicia. The shipping label has a back face which has a first strip of adhesive, a second strip of adhesive, and a printable area. The first and second adhesive strips respectively extend along a top edge and a bottom edge of the shipping label. The printable area is between the first and second adhesive strips. The liner is configured to cover the first and second adhesive strips. The method includes the step of printing the printable area after the liner is removably secured to the back face.

According to yet another embodiment, a single-ply shipping label configured to be adhered to a liner comprises a front face configured for the printing of indicia and a back face. The back face has an adhesive border and a printable area inwardly adjacent the adhesive border. The liner has an inner boundary and an outer boundary. The inner boundary defines a central void that corresponds to the printable area when the liner is removably secured to the back face. The central void allows for indicia to be printed on the printable area while the liner is removably secured to the back face.

BRIEF DESCRIPTION OF THE SEVERAL VIEWS OF THE DRAWINGS

Illustrative embodiments of the present invention are described in detail below with reference to the attached drawing figures and wherein.

DETAILED DESCRIPTION

A shipping label is adhered to a package and identifies the sender and recipient of the package. Conventional shipping labels have a front face for the printing of indicia and a back face that is adhered to the package. Traditionally, the entire back face is covered with adhesive, and a liner is removably secured to the back face via this adhesive. Prior to use, the liner is removed, either by hand or otherwise, and the label is adhered to the package being delivered.

The label liner is traditionally a single-use, disposable object. In the prior art, because the label back side is generally fully covered with adhesive, the size of the liner corresponds to the size of the label back face. Considering that there are many millions of shipping labels in use each day, disposal of these relatively large liners of each of these many labels represents significant waste. It may be desirable to reduce this waste to lower the carbon footprint of labels on the world; particularly when this waste is reduced without adversely affecting the quality or capabilities of the label, or their ease of use.

Figure 1:
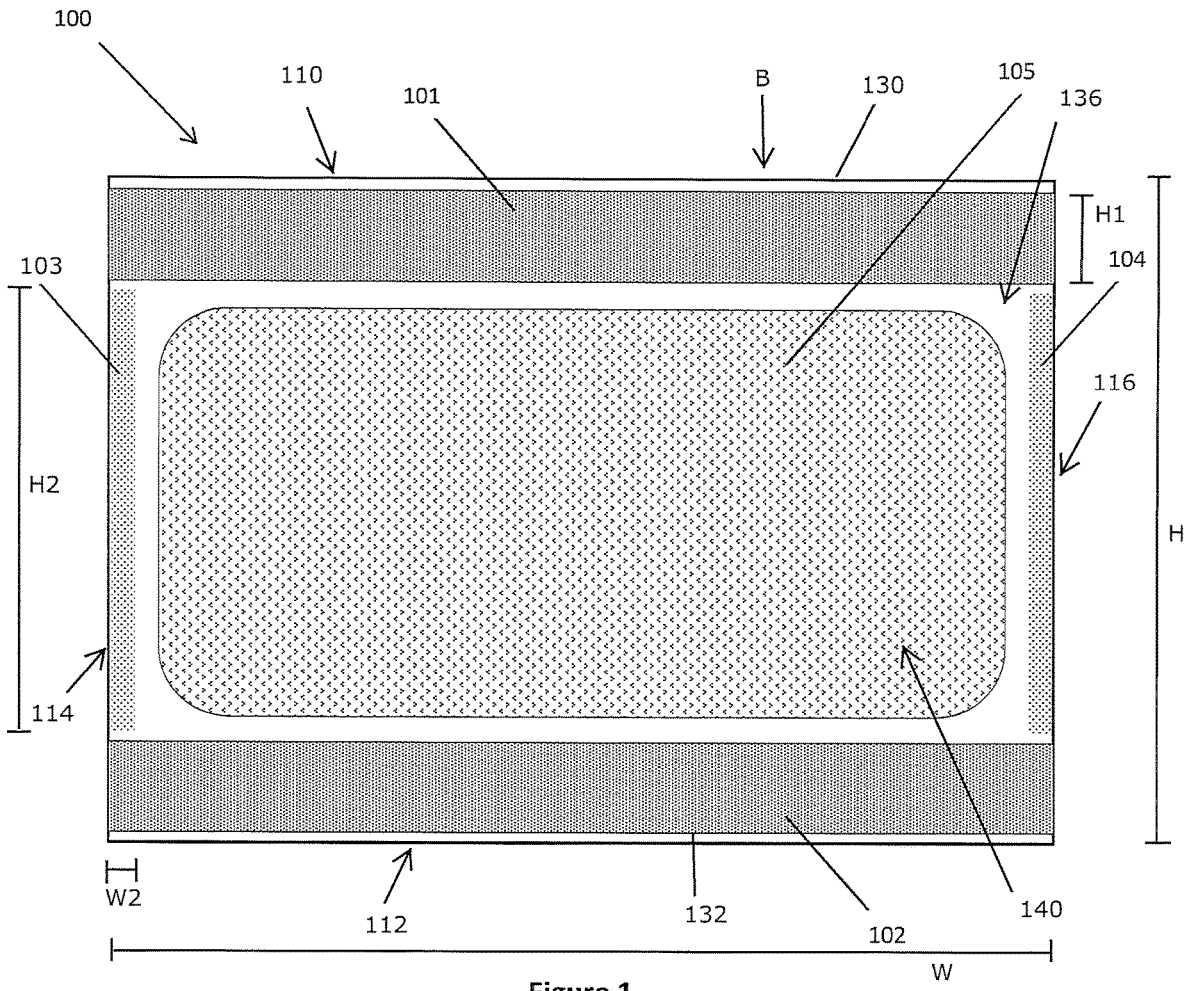
FIG. 1 is a top view of a back side of a label, according to an embodiment of the present disclosure.
Figure 7:
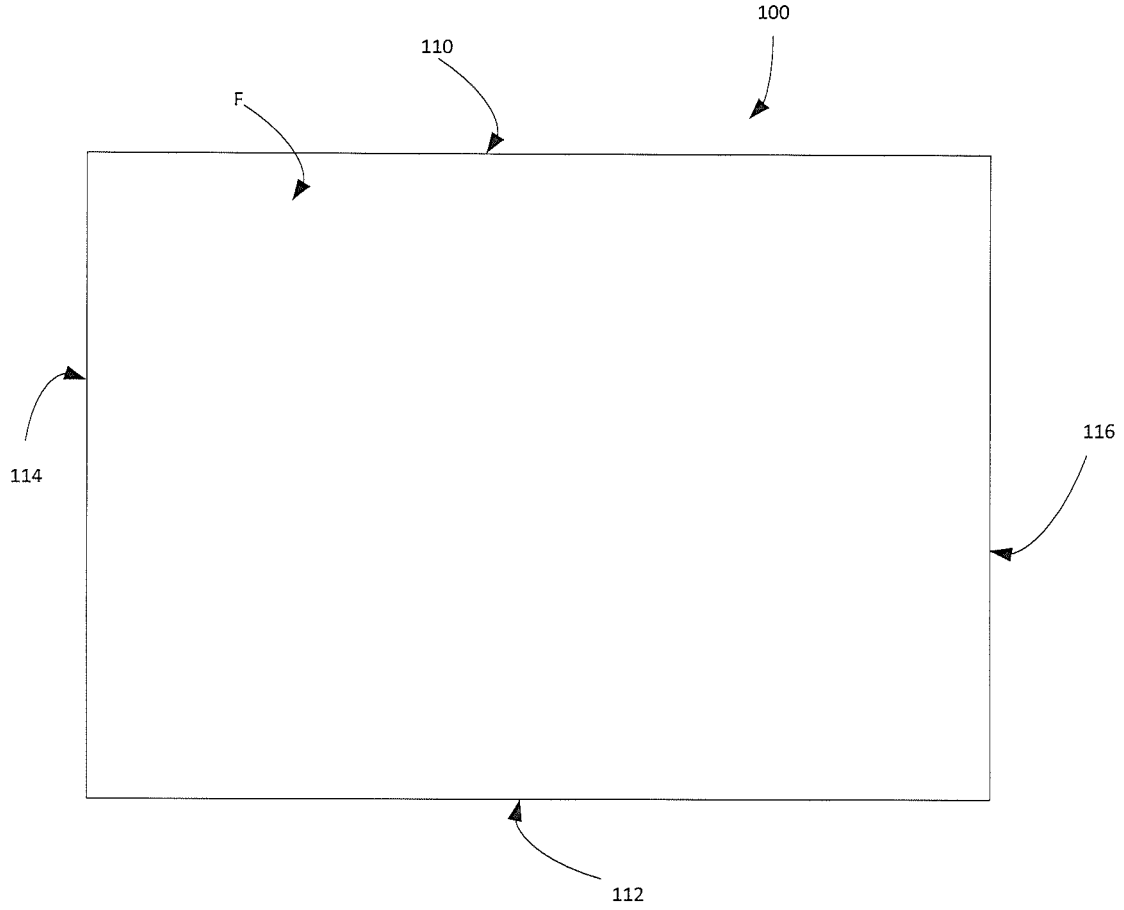
FIG. 7 is a top view of a front side of the label of FIG. 1.

Attention is directed now to FIGS. 1 and 7, which respectively show a back side B and a front side F of a label 100, according to an example embodiment of the present disclosure. As can be seen, the label 100, akin to traditional shipping labels, is generally symmetrical (e.g., rectangular or square shaped), though other regular and irregular shapes are also contemplated.

The label 100 may have a first (or top) lateral edge 110, a second (or bottom) lateral edge 112, a first vertical (or left) edge 114, and a second vertical (or right) edge 116. The label 100 may have a height H and a width W (see FIG. 1). In the illustrated embodiment, the width W is greater than the height H; however, in other embodiments, the width W may be equal to or less than the height W.

As is customary, the front side F of the label 100 may be configured to receive indicia (e.g., printed indicia, handwritten indicia, etc.). For example, a user placing the label 100 on a package may write and/or print the name and address of the recipient (and, in embodiments, of the sender) on the label front side F. In some embodiments, only a subsection of the front side may be configured for the reception of indicia.

FIG. 1 shows the label back side B without a liner (discussed below) that is removably adhered thereto. In the illustrated embodiment, the back side B may, adjacent the first and second lateral edges 110 and 112, include strips of adhesive 101 and 102, respectively, that extend parallel to these edges 110 and 112. The adhesive strips 101, 102 may each be generally rectangular, and may each have a height H1 and a width W. The height H1 of each adhesive strip 101, 102 (and the height of both the adhesive strips 101, 102 collectively) may be significantly less than the height H of the label 100. In some embodiments, the height H may be at least five (or a different number of) times greater than the height H1.

The adhesive strips 101, 102 extending along the top edge and the bottom edge 110, 112 may comprise any suitable type of adhesive, such as permanent adhesive, removable adhesive, freezer grade adhesive, acrylic adhesive, hot melt adhesive, remoistening adhesive, pressure sensitive adhesive, et cetera, or some combination thereof. Further, the size (e.g., width and thickness), coat weight, et cetera, of the adhesive strips 101, 102 may be selected in line with the requirements of a particular application. In some embodiments, the adhesive strips 101, 102 extending along the top and bottom edges may be generally identical, whereas in other embodiments, one adhesive strip may be different from the other (e.g., the adhesive strip 101 extending along the top edge 110 may have a higher coat weight or be wider than the adhesive strip 102 extending along the bottom edge 112).

In embodiments, the adhesive strip 101 on the back side B of the label 100 may (but need not) be spaced apart from the top edge 110, and the adhesive strip 102 on the back side B of the label 100 may be spaced apart from the bottom edge 112. Thus, an area 130 between the top edge 110 and the adhesive strip 101 and an area 132 between the bottom edge 112 and the adhesive strip may be devoid of adhesive (and may be devoid of a printable coating).

Further, on the back side B, adhesive strips 103, 104 may be provided along and adjacent the left edge 114 and the right edge 116, respectively. These adhesive strips 103, 104 extending along the left and right edges 114, 116 may similarly comprise any suitable adhesive(s), and their dimensions may be configured in line with the requirements of a particular application. In the illustrated embodiment, each adhesive strip 103 and 104 has a height H2, which is less than the height H of the label 100 and is greater than the height H1 of the adhesive strips 101, 102. Each adhesive strip 103, 104 may have a width W2, which is less than the width W of the label 100. In some embodiments, the width W may be at least seven (or a different number of) times greater than W2. In some embodiments, particularly where the label 100 is extra-wide or extra-tall, a strip of adhesive may also extend vertically or horizontally through the middle of the back side B to ensure that the label 100 suitably adheres to a package or other substrate. In some embodiments, the adhesive strips 101, 102, 103, 104 may form a continuous border.

In embodiments, a blank defining portion 136 of the back side B (i.e., a portion that is devoid of adhesive and is devoid of printable coating) inwardly adjacent each of the adhesive strips 101, 102, 103, and 104 may define a central printable area 105 on the back side B. This central printable area 105, which may be a rectangle with rounded corners as shown or of other regular or irregular shapes, may be configured to receive handwritten and/or printed indicia (e.g., the printable area 105 may be provided with coating 140 configured to receive printed ink). The indicia on the back side B (i.e., on the central printable area 105) may include a packing slip outlining the contents of the package to which the label 100 is adhered; alternately or additionally, a coupon, a voucher for the next order, a gift card, etc., may be provided on the central printable area 105. In a currently preferred embodiment, the label 100 (without the liner, discussed further below) is formed of a single ply (i.e., the back side B and the front side F are the two opposing sides of the same ply); hence, in embodiments where the printable area 105 indicates the contents of the package to which the label 100 is to be adhered to, the need to print a separate packing slip on a different sheet may be eliminated.

In some embodiments, the entire back side B may initially be printable (e.g., include a printable coating) and the adhesive strips 101, 102, 103, 104 may be thereafter situated on the back side B. In some embodiments, the adhesive strips 101, 102, 103, and 104 may first be situated on the back side B, and then the printable coating may be disposed in the area inwardly adjacent the adhesive strips 101, 102, 103, and 104. The blank defining portion 136 may, in embodiments, be omitted; in these embodiments, the entire area of the back side B not covered by the adhesive strips 101, 102, 103, or 104 may be specifically adapted for the printing of indicia.

Figure 2:
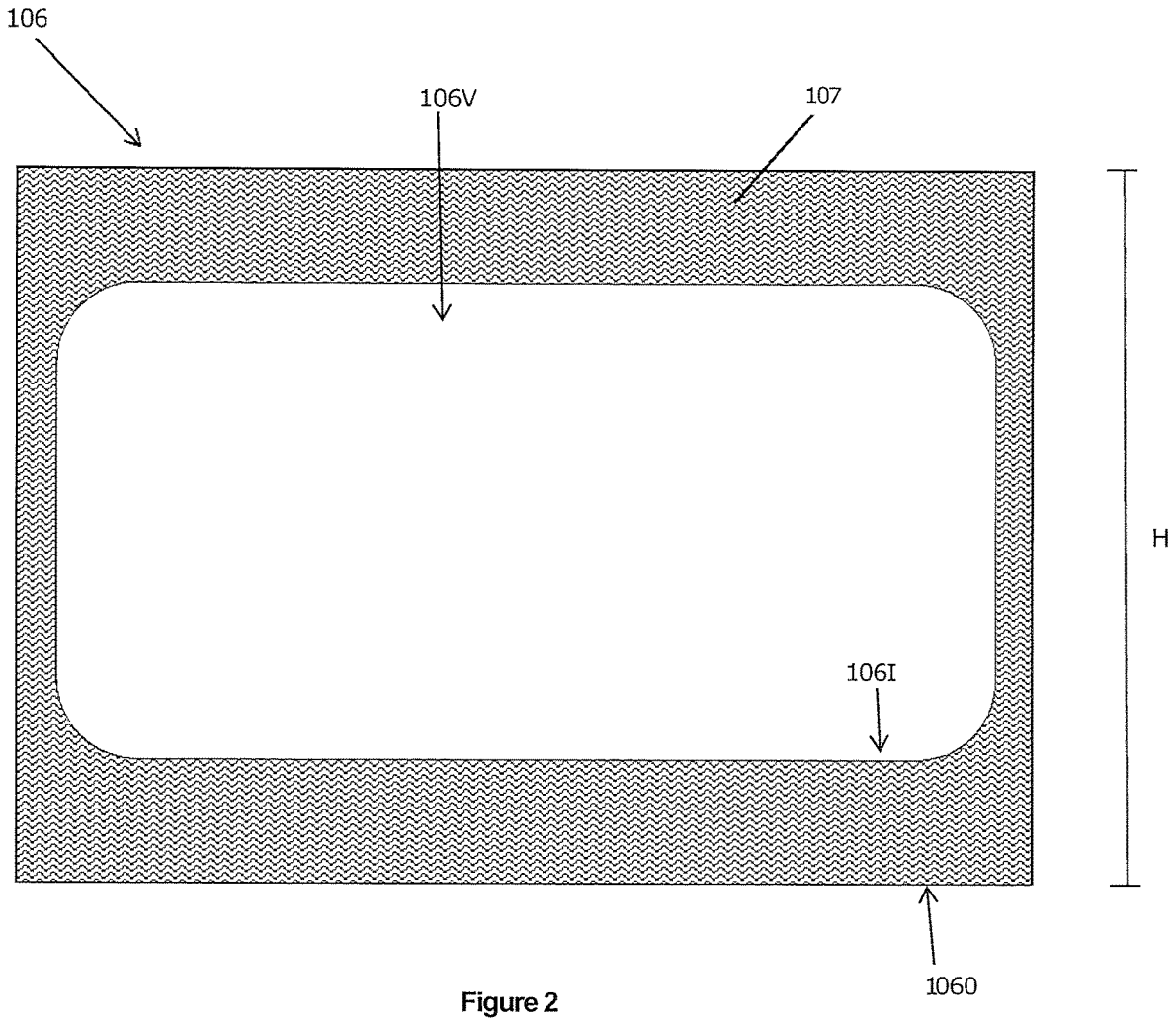
FIG. 2 is a top view of a disposable liner for use with the label of FIG. 1, according to an embodiment.

Focus is directed now to FIG. 2, which shows an embodiment of the liner 106 that may be used to temporarily cover the adhesive areas 101, 102, 103, and 104 described in FIG. 1. The liner 106 may but need not be printable. The artisan will appreciate that printing on the central printable area 105 discussed above is effectuated without printing on the liner 106 itself.

The liner 106 may comprise paper or other suitable materials. The liner 106 (i.e., the side of the liner 106 that will contact the back side B of the label 100) may be treated with a release material (e.g., silicone) 107 so that the liner 106 can be readily removed after it is adhered to the back face B of the label 100. The term label 100, as used herein, refers to the label without the associated liner 106.

In a currently preferred embodiment, the liner 106 may have an outer boundary 1060 and an inner boundary 1061. The outer boundary 1060 may be generally rectangular and have a height H and a width W (i.e., the height and width of the liner 106 outer periphery may be the same as that of the label 100). The inner boundary 1061 of the liner 106 may define a central void 106V (i.e., an opening) which may (though need not) generally correspond to the central printable area 105 on the label back side B when the liner 106 is removably adhered to the adhesive strips 101, 102, 103, and 104.

According to an embodiment, the liner 106 only covers the adhesive areas 101, 102, 103, and 104 extending along the edges of the label 100, or at least includes the central gap 106V to allow for printing on a part of the printable area 105 while the liner 106 is adhered to the label 100 (i.e., to the back side B thereof). The liner 106, because of its central gap 106V, may reduce by up to forty percent the waste associated with traditional shipping label liners.

In use, the label front side F and the label back side B (i.e., the central printable area 105 thereof) may be printed together (e.g., in a double sided printer) or separately, either after the application of the liner 106 to the backside B or before said application. The liner 106 may be removed when the label back side B is to be adhered to a package. Once the liner 106 is removed, the adhesive strips 101, 102, 103, and 104 may allow all four edges of the label back side B to be adhered to the package or other substrate.

Figure 8:
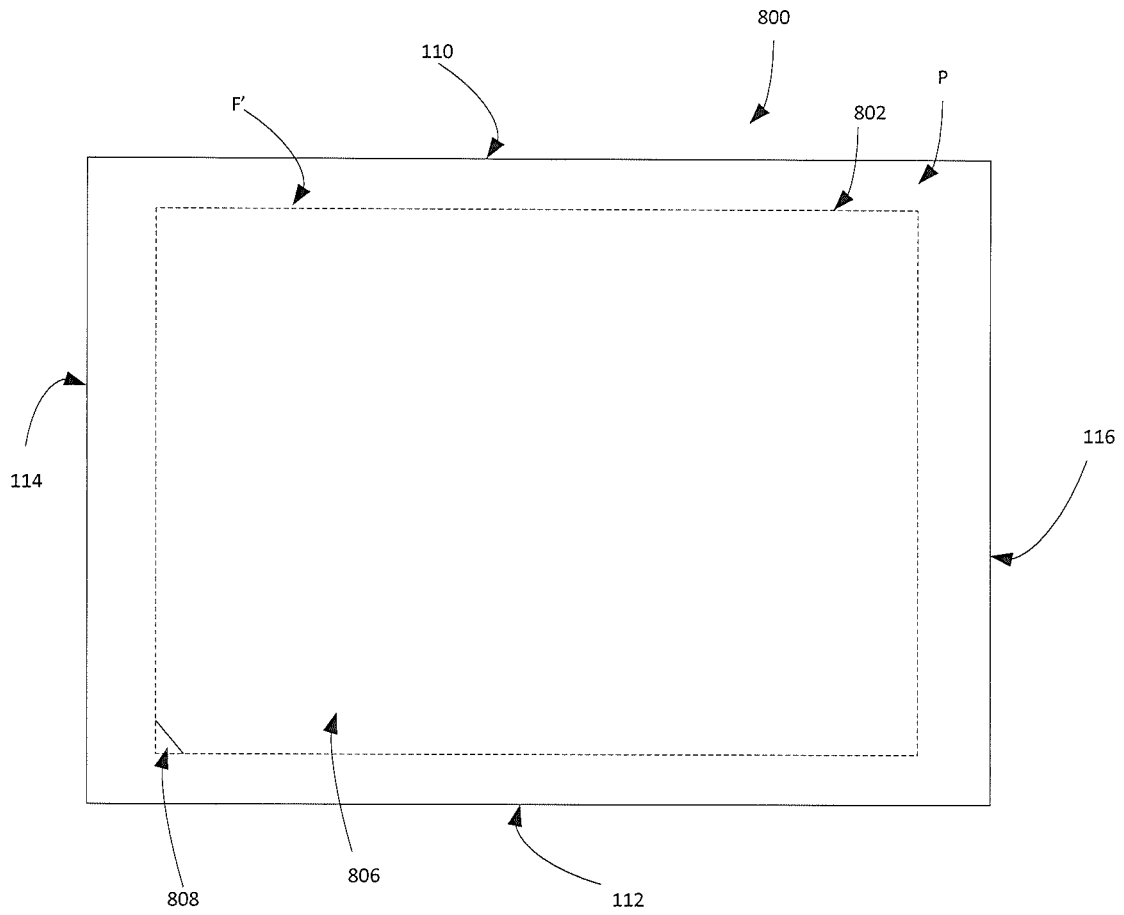
FIG. 8 is a top view of a front side of another embodiment of the label of FIG. 1.

Attention is directed now to FIG. 8, which show an alternate embodiment 800 of the label 100. The label 800 may be similar to the label 100, except as specifically noted and/or shown, or as would be inherent. Further, those skilled in the art will appreciate that the label 100 (and thus the label 800) may be modified in various ways, such as through incorporating all or part of any of the various described embodiments, for example. For uniformity and brevity, corresponding reference numbers may be used to indicate corresponding parts, though with any noted deviations.

FIG. 8 shows a front side F' of the label 800. The primary difference between the label 100 and the label 800 is that unlike the label 100, the label 800 includes perforations or lines of weakness 802 that extend through the single ply P forming the label, as shown in FIG. 8. The perforations 802 may be rectangular as shown or take on other regular or irregular shapes, and may be inwardly adjacent the edges 110, 112, 114, and 116. In embodiments, the perforations 802 may define a central removable portion 806. A tab 808 may be associated with the central removable portion 806 and may allow an end user to remove the removable central portion 806 from the remainder of the label 100 via the perforations 802.

It is envisioned that the label 800 will be printed on both sides (i.e., the front side F' and the back side which may be generally identical to the back side B, either before or after the liner is removably secured thereto) and adhered to a package. The end user (i.e., the recipient of the package) may use the tab 808 to conveniently remove the removable central portion 806 and thereby access the contents on the back side of the label 800. Of course, the end user may also tear the label 100 off the package and access the indicia on the back side B thereof, but the perforations 802 may simplify access to the indicia printed on the back side of the label. The artisan will understand that the pull tab 808, including the location thereof, is merely exemplary, and that other means may be provided to allow the user to tear off the central portion 806 from the label 800 once the label 800 has been adhered to a package. The skilled artisan will further appreciate that the removable portion 806, on the back side thereof, may not contain any adhesive (or alternately, the adhesive may be such that it allows the end user to easily remove the central portion 806 from the remainder of the label 800). The ply P may allow the indicia printed (or otherwise placed on the back side of the label) to be hidden from view while the shipping label 800 is adhered to the package.

Figure 9:
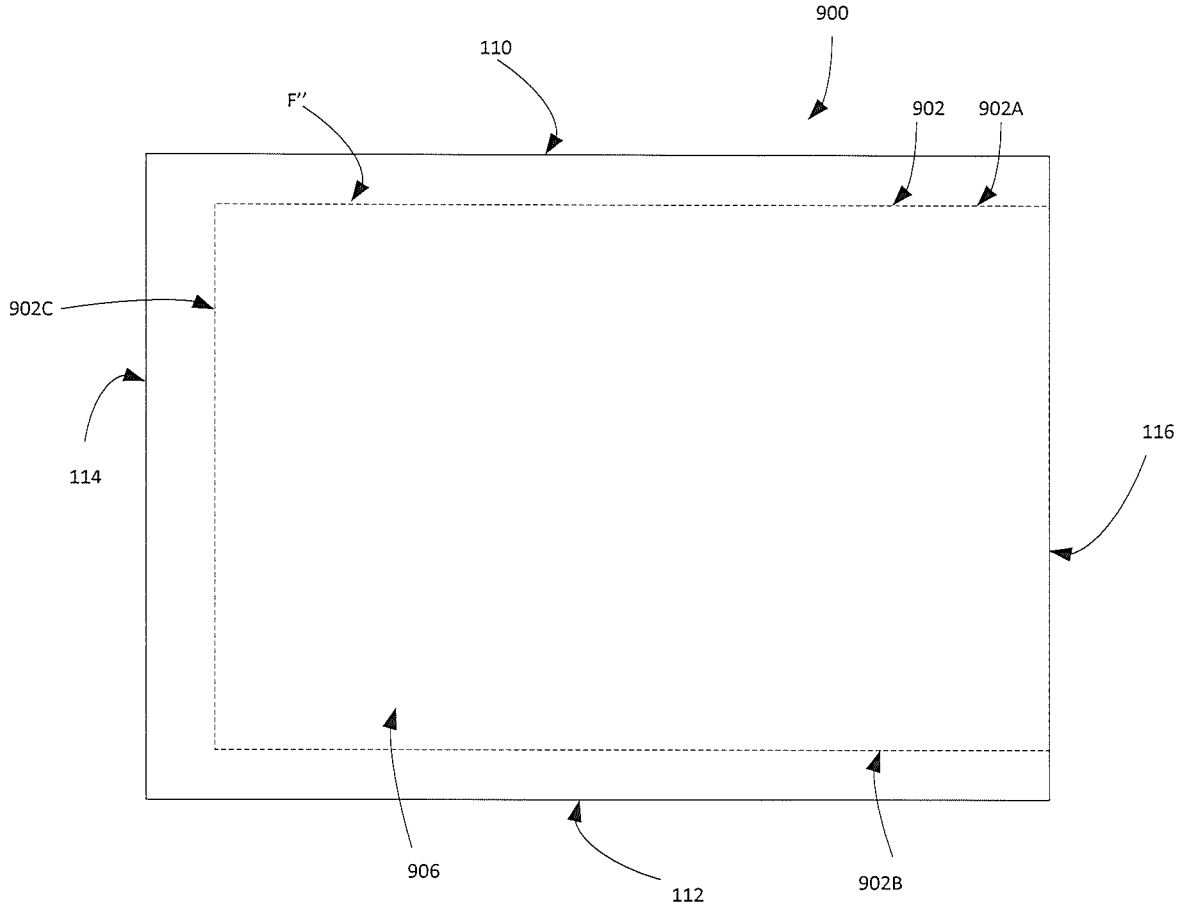
FIG. 9 is a top view of a front side of yet another embodiment of the label of FIG. 1.

Focus is directed now to FIG. 9, which show an alternate embodiment 900 of the label 800. The label 900 may be similar to the label 800, except as specifically noted and/or shown, or as would be inherent. Further, those skilled in the art will appreciate that the label 800 (and thus the label 900) may be modified in various ways, such as through incorporating all or part of any of the various described embodiments, for example. For uniformity and brevity, corresponding reference numbers may be used to indicate corresponding parts, though with any noted deviations.

A primary difference between the label 800 and the label 900 may be that, unlike the perforations 802 which independently form a rectangle (or square or other closed shape), the perforations 902 of the label 900 may have an open side or end. More specifically, the perforations 902 may include a line of peroration 902A that is inwardly adjacent and extends parallel to the top edge 110, a line of peroration 902B that is inwardly adjacent and extends parallel to the bottom edge 112, and a line of perforation 902C that is inwardly adjacent and extends parallel to the first vertical edge 114. However, the perforations 902, unlike the perforations 802, may be devoid of a fourth line of perforation; instead, each of the lines of perforations 902A and 902B may extend all the way up to the second vertical edge 116. The perforations 902 (i.e., the lines of perforation 902A, 902B, and 902C), together with the second vertical edge 116, may define a removable portion 906. The end user may remove the removable portion 906 along the perforations 902 to access the indicia printed on the back side of the label 900. As with other embodiments, the indicia on the back side of the label 900 may be printed before or after the liner is removably adhered to the back side.

In embodiments, the label 900 may be devoid of a tab (e.g., the tab 808 shown in FIG. 8); rather, the end user may place his hand underneath the fourth edge 116 to facilitate the removal of the central portion 906 from the remainder of the label 900 adhered to the package. In embodiments, the adhesive strip 104 (see FIG. 1) that is inwardly adjacent the second vertical edge 116 on the back side may be omitted to allow the user to conveniently place his hand (or finger(s)) underneath the edge 116 and into a gap formed between the second vertical edge 116 and the package (the artisan will understand that in this configuration, the label 900 may be suitably secured to the package notwithstanding that the area adjacent the second vertical edge 116 is not secured to the package in its entirety). The back side of the label 900 (and of the label 800) may otherwise be generally identical to the back side B of the label 100.

Figure 3:
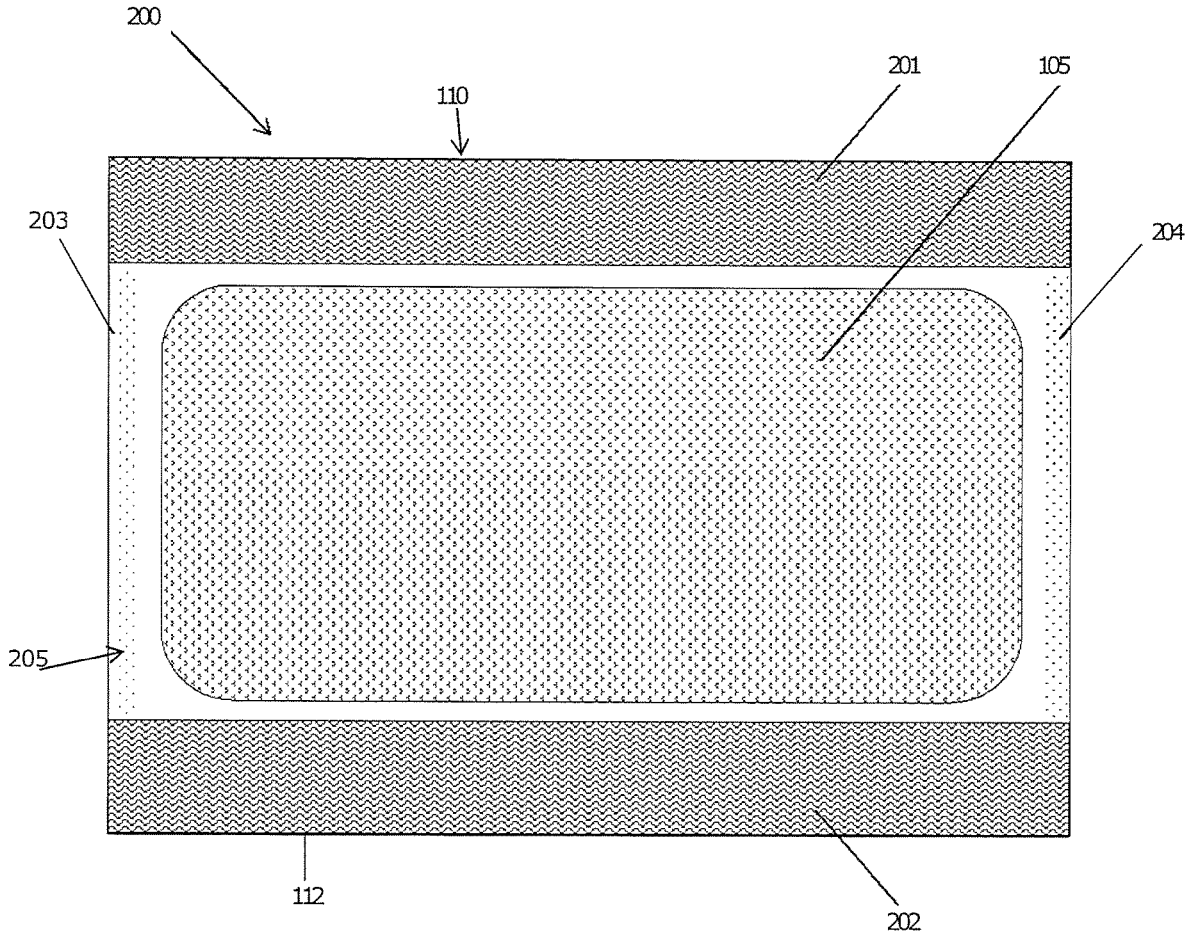
FIG. 3 is a top view of a back side of an alternate embodiment of the label of FIG. 1.

Focus is directed now to FIG. 3, which shows an alternate embodiment 200 of the label 100. The label 200 may be similar to the label 100, except as specifically noted and/or shown, or as would be inherent. Further, those skilled in the art will appreciate that the label 100 (and thus the label 200) may be modified in various ways, such as through incorporating all or part of any of the various described embodiments, for example. For uniformity and brevity, corresponding reference numbers may be used to indicate corresponding parts, though with any noted deviations.

In this embodiment 200, strips of adhesive 201, 202, 203, and 204 may be provided, and these adhesive strips may respectively be generally identical to the adhesive strips 101, 102, 103, and 104 discussed above with respect to FIG. 1. Unlike the embodiment 100, however, adhesive strips 203, 204 inwardly adjacent the side edges 114, 116 (or one or more other adhesive strips) may each include a deadening agent 205. The deadening agent 205 may be a conventional water based deadening agent, a solvent based deadening agent, a UV cured deadening agent, or another deadening agent now known or subsequently developed. The deadening agent 205 may reduce the tackiness of the patterned adhesive strips 203, 204 extending along the side edges 114, 116, respectively, but may nevertheless allow for the label 100 to be secured to the package on all sides. While not required, in embodiments, the front side of the label 200 may include perforations (as shown in FIGS. 8 and 9, for example, that extend through the label 200, i.e., through the solitary ply thereof) to allow the end user to remove a central portion of the label 200 after it is adhered to the package.

A liner corresponding to the label 200 may be configured to cover only the adhesive strips 201, 202 extending along the top and bottom edges 110, 112. More particularly, the deadening agent 205 on the side edges 114, 116 may make it unnecessary to cover the adhesive strips 203, 204 extending along these side edges 114 and 116. Thus, the liner may simply comprise two separate strips, each of which may removably be adhered to one of the top and bottom adhesive strips 201 and 202. The back side of the label 200 may, like the back side B of the label 100, advantageously include the printable area (e.g., printable area 105), but the liner of the label 200 may further reduce the waste associated with the liners of labels as compared to the liners of the label 100. Of course, taller or wider labels may be provided with additional adhesive strips to facilitate secure adhesion to a package, and the liner may in some embodiments be configured to also cover the additional adhesive strips. While FIG. 3 shows a blank area outwardly adjacent the printable area 105 and between the printable area 105 and the adhesive strips 201, 202, 203, and 204, the artisan will understand from the disclosure herein that the blank area may be omitted such that the entire area of the back side not covered by adhesive is configured to be printable. Elimination of the blank area—to allow for the printing of the entire back side area not covered by adhesive—is envisioned for all embodiments disclosed herein.

Figure 4:
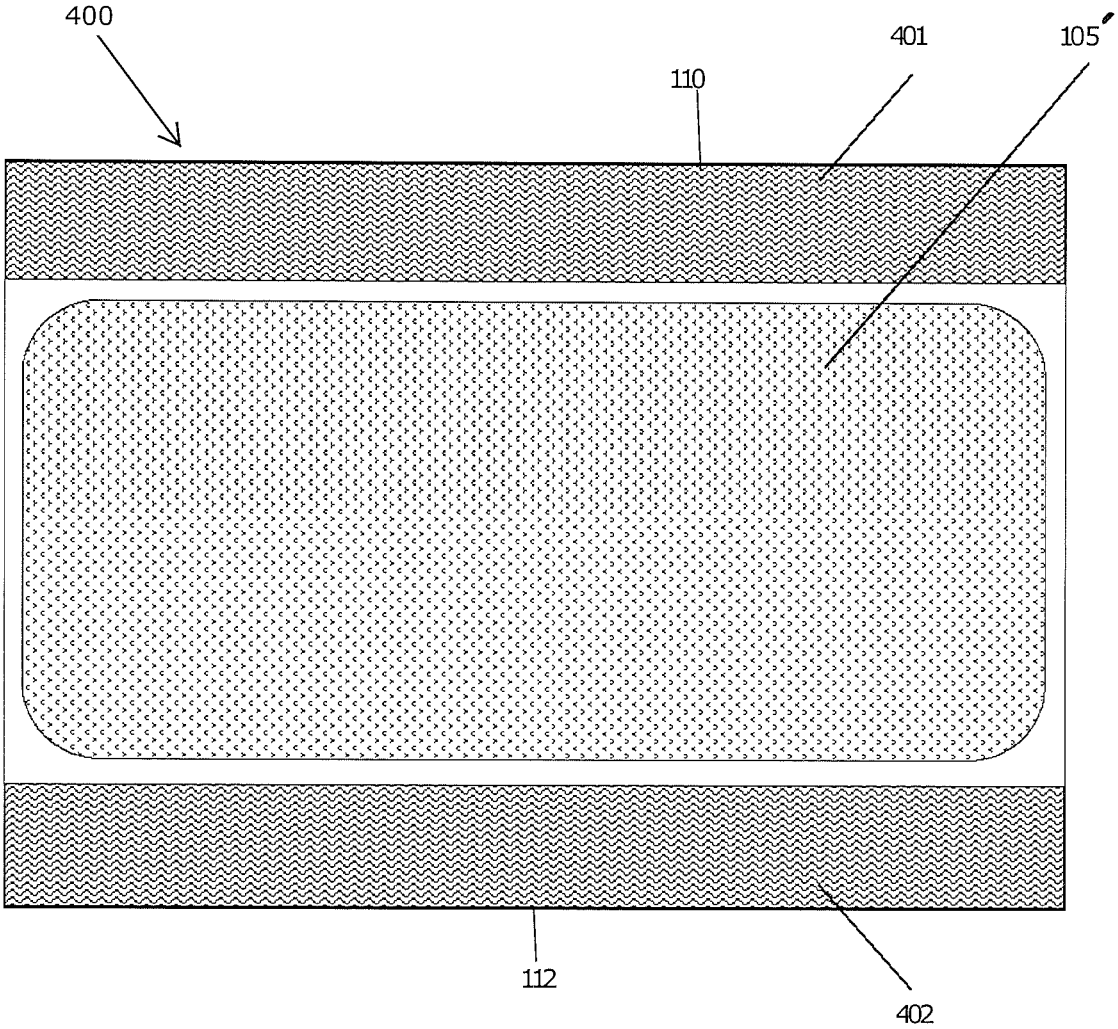
FIG. 4 is a top view of a back side of another alternate embodiment of the label of FIG. 1.

FIG. 4 shows a label 400, which is yet another alternate embodiment of the label 100. As can be seen, the label 400 is different from the label 200 in that the adhesive strips extending along the left and right side edges 114, 116 have been omitted, leaving only adhesive strips 401, 402 extending along the top and bottom edges 110, 112, respectively. As with label 200, the liner of the label 400 need only cover the adhesive strips 401, 402 extending along the top and bottom edges 110, 112 of the label 400. The absence of the adhesive strips extending along the left and right sides 114, 116 of the label 400 may allow for an enlarged printable area 105' as compared to the label 100; for example, the printable area 105' on the back side of the label 400 may extend to the left and right side edges 114, 116, or terminate closer to these side edges 114, 116 as compared to the printable area 105 of the label 100.

Figure 5:
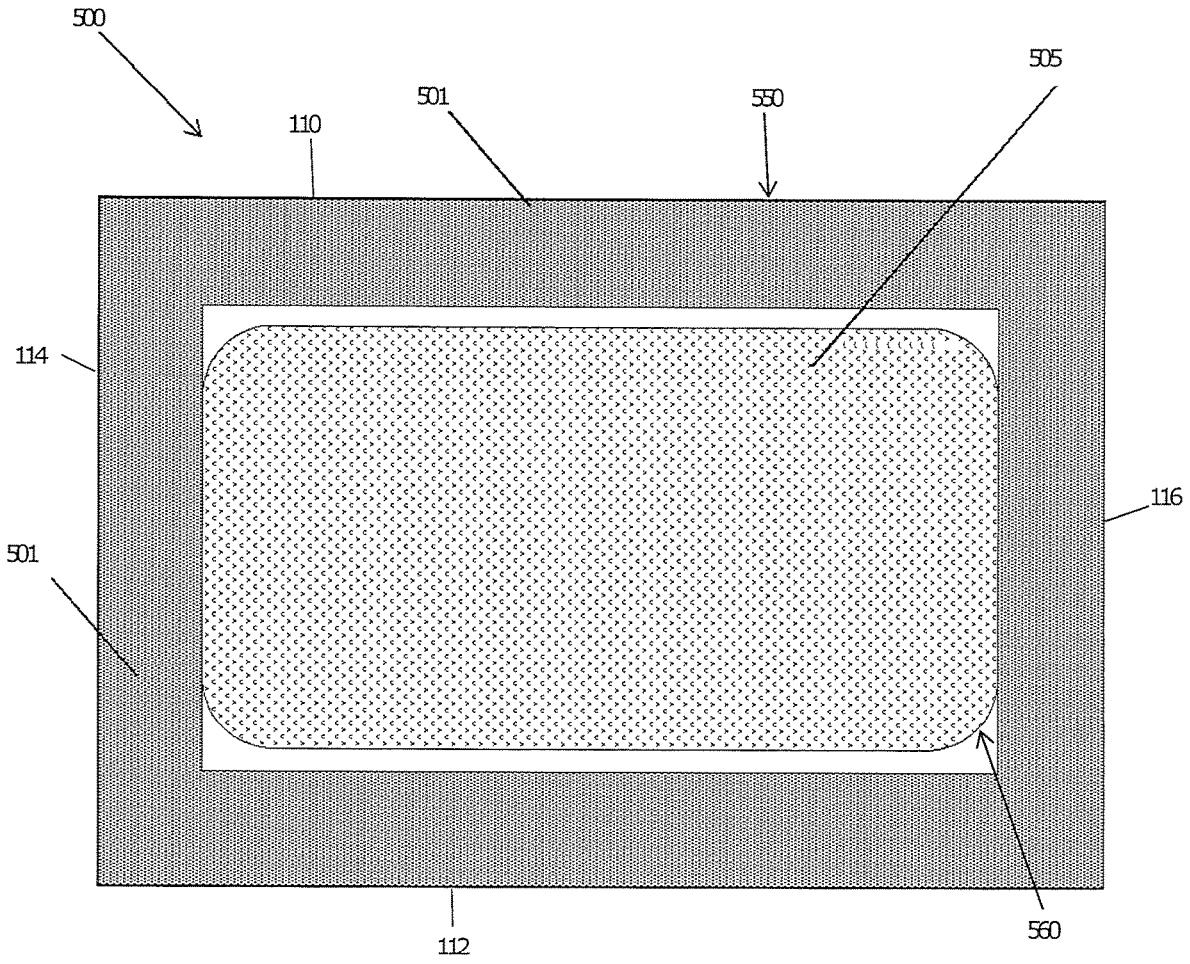
FIG. 5 is a top view of a back side of another alternate embodiment of the label of FIG. 1.

Focus is directed now to FIG. 5, which show a back face 550 of an alternate embodiment 500 of the label 100. The label 500 may be similar to the label 100, except as specifically noted and/or shown, or as would be inherent. Further, those skilled in the art will appreciate that the label 100 (and thus the label 500) may be modified in various ways, such as through incorporating all or part of any of the various described embodiments, for example. For uniformity and brevity, corresponding reference numbers may be used to indicate corresponding parts, though with any noted deviations.

Figure 6:
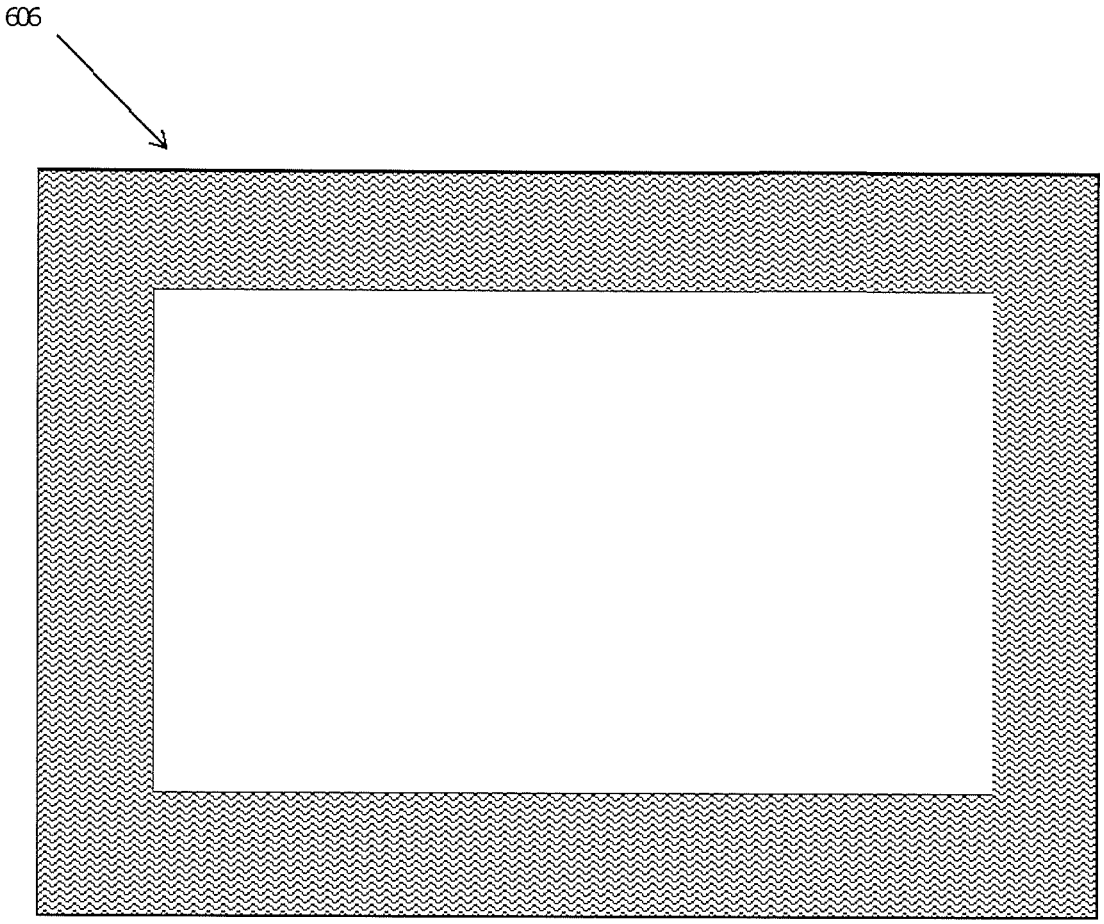
FIG. 6 is a top view of a disposable liner for use with the label of FIG. 5.

The label 500 may have an adhesive border 501 that surrounds the label 500 back face on all edges 110, 112, 114, and 116. The width of the top and bottom sides of the adhesive border 501 may be equal in this embodiment to the width of the right and left sides of the adhesive border 501 such that the adhesive border 501, together with an optional blank portion 560, collectively define a picture frame type printable area 505 on the back face 550 of the label 500. As with the other embodiments, the printable area 505 on the back side 550 may be coated or be otherwise configured for the printing of indicia. The printable area 505, in this and other embodiments, may include the entire area on the back face of the label 500 that is not covered with adhesive (and indeed, the portions of the label ply in contact with the adhesive strips may also, in embodiments, include printable coating). Alternately, the printable area 505 may be a subset of the area on the back face 550 that is not covered with the adhesive border 501. For example, as shown in FIG. 5, the printable area 505 may be generally rectangular and have rounded corners. Alternately, the printable area 505 may take on other symmetrical or non-symmetrical shapes. While not required, in some embodiments, a visible border defining the printable area 505 may be provided for the convenience of the consumer. The liner 606 for the label 500, as shown in FIG. 6, may be configured such that it covers the adhesive border 501 in its entirety, while allowing for printing on the printable area 505 to be effectuated even after the liner 606 is adhered thereto.

The facestock of the labels (e.g., the labels 100, 200, 400, 500, 800, 900, etc.) disclosed herein may comprise any suitable material (e.g., paper or synthetic materials), and in embodiments, may consist of a solitary ply. The artisan will understand that through the use of printable coatings, various printing applications may be accommodated. The labels 100, 200, 400, 500, 800, and 900 may be provided as individual sheets, allowing for printing thereof in desktop printers and the like. Alternately, the labels (e.g., each of the labels 100, 200, 400, 500, 800, and 900) may be provided in roll form, and be printed using a continuous feed printer. If prepared in rolls, the labels may include a perforation (e.g., a vertical or horizontal perforation) to allow for separation of the labels. In some embodiments, the continuous printer may be provided with an automated peeler/cutter to automate these processes.

It will be appreciated that the top, bottom, right, and left edges, as referenced herein, are intended to illustrate the features of the labels and are not independently limiting. For example, labels having adhesive strips on their side edges, but which are devoid of adhesive strips on their top and bottom edges, are also contemplated.

It will further be appreciated that the printing on the central printable areas on the back faces of the various labels (e.g., labels 100, 200, 400, 500, 800, and 900) disclosed herein does not equate to printing on the liners of the various labels.

Many different arrangements are possible without departing from the spirit and scope of the present invention. Embodiments of the present invention are described herein with the intent to be illustrative rather than restrictive. Alternative embodiments will become apparent to those skilled in the art that do not depart from its scope. A skilled artisan may develop alternative means of implementing the disclosed improvements without departing from the scope of the present invention. Further, it will be understood that certain features and sub combinations are of utility and may be employed without reference to other features and sub combinations and are contemplated within the scope of the claims. The description should not be restricted to the specific described embodiments.

The invention claimed is:

1. A shipping label formed of a single ply configured to be removably adhered to a liner, the shipping label comprising:

a front face configured for the printing of indicia;

a back face having an adhesive region and a central printable region inboard the adhesive region and comprising a printable coating; the shipping label having adhesive only in the adhesive region; the adhesive region having only a first linear strip of adhesive, a second linear strip of adhesive, and a third linear strip of adhesive, the first linear strip of adhesive extending parallel to a first edge of the single ply, the second linear strip of adhesive extending parallel to a second edge of the single ply, and the third linear strip of adhesive extending parallel to a third edge of the single ply and being perpendicular to the first and second linear strips of adhesive; the central printable region being circumscribed by a blank defining portion, the blank defining portion being devoid of the adhesive and the printable coating; the central printable region being located in a first horizontal plane;

the liner; the liner configured to cover only the adhesive region such that the central printable region remains exposed; the liner consisting of three linear strips, each of the three linear liner strips of the liner covering a different one of the first linear strip of adhesive, the second linear strip of adhesive, and the third linear strip of adhesive; the liner being located in a second horizontal plane;

wherein:

the central printable region is adapted to be printed with personalized indicia while the liner is removably secured to the adhesive region; and the single ply includes a first perforated line extending parallel to the first edge, a second perforated line extending parallel to the second edge, and a third perforated line extending parallel to the third edge, a fourth edge of the single ply having no perforated line associated therewith, each of the first perforated line and the second perforated line terminating at the fourth edge and collectively forming a gap between the single ply and a substrate to which the single ply is adhered, the gap being usable to detach the central printable region from a remainder of the single ply.

2. The shipping label of claim 1 wherein the central printable region further comprises a gift card.

3. The shipping label of claim 1, wherein the central printable region further comprises a coupon.

4. The shipping label of claim 1, wherein the liner comprises paper.

5. The shipping label of claim 1, wherein the adhesive region comprises freezer grade adhesive.

6. A method for reducing liner waste associated with shipping labels, comprising:

providing a single-ply shipping label to which a liner is to be adhered, the shipping label comprising:

a front face configured for the printing of indicia;

a back face having an adhesive region and a central printable region, the central printable region being inboard the adhesive region and comprising a printable coating; the shipping label having adhesive only in the adhesive region; the adhesive region having only a first linear strip of adhesive, a second linear strip of adhesive, and a third linear strip of adhesive; the first linear strip of adhesive extending along a first edge of the single-ply, the second linear strip of adhesive extending along a second edge of the single-ply, and the third linear strip of adhesive extending along a third edge of the single-ply and being perpendicular to the first and the second linear strips of adhesive; the central printable region being circumscribed by a blank defining portion that is devoid of each of the adhesive and the printable coating; an area of the central printable region being greater than an area of the adhesive region;

the liner; the liner configured to cover only the adhesive region such that the central printable region remains exposed; the liner having only a first linear strip corresponding to the first linear strip of adhesive, a second linear strip corresponding to the second linear strip of adhesive, and a third linear strip corresponding to the third linear strip of adhesive; and printing the central printable region while the liner is removably secured to the back face;

wherein:

the single-ply includes a first perforated line extending parallel to the first edge, a second perforated line extending parallel to the second edge, and a third perforated line extending parallel to the third edge; a fourth edge of the single-ply having no perforated line associated therewith, each of the first perforated line and the second perforated line terminating at the fourth edge, a gap being formed at the fourth edge between the single-ply and a substrate to which the single-ply is adhered, the gap being usable to detach the central printable region from a remainder of the single-ply.

7. The method of claim 6, further comprising the step of simultaneously printing indicia on the front face and the central printable region.

8. The method of claim 6, wherein the central printable region further comprises a gift card.

9. A method for making a label with reduced liner waste, comprising:

providing the label, the label comprising:

a front face of a face ply configured for the printing of indicia;

a back face of a face ply having an adhesive region and a printable region comprising printable coating inboard the adhesive region; the label having adhesive only in the adhesive region; the adhesive region comprising a first linear strip of adhesive extending parallel to a first edge of the face ply, a second linear strip of adhesive respectively extending parallel to a second edge of the face ply, and a third linear strip of adhesive extending parallel to a third edge of the face ply and being perpendicular to the first and the second linear strips of adhesive; a fourth edge of the face ply having no strip of adhesive associated therewith; a blank defining portion devoid of each of the printable coating and the adhesive surrounding the printable region; an area of the printable region being greater than an area of the adhesive region; and a liner; the liner configured to cover only the adhesive region such that the printable region remains exposed; no portion of the liner extending parallel to the fourth edge;

removably securing the liner to the adhesive region; and printing indicia on the printable region while the liner is removably secured to the adhesive region;

wherein:

a line of perforation extends parallel to and is proximate each of the first edge, the second edge, and the third edge, and no line of perforation is associated with the fourth edge.

10. The method of claim 9, wherein the printable region is adapted to include a packing list.

11. The method of claim 9, wherein no indicia is printed on the liner while the liner is secured to the adhesive region.

12. The method of claim 9, further comprising securing the label to a substrate such that gap is formed between the fourth edge and the substrate, the gap usable to detach the central portion from the remainder of the face ply.

13. The method of claim 9, further comprising providing a gift card on the back face.

* * * * *